US011754270B2

(12) United States Patent
Feng et al.

(10) Patent No.: US 11,754,270 B2
(45) Date of Patent: Sep. 12, 2023

(54) LAMP

(71) Applicants: SUZHOU OPPLE LIGHTING CO., LTD., Suzhou (CN); OPPLE LIGHTING CO., LTD., Shanghai (CN)

(72) Inventors: Xuejun Feng, Suzhou (CN); Yueping Wang, Suzhou (CN); Shitao Deng, Suzhou (CN)

(73) Assignees: SUZHOU OPPLE LIGHTING CO., LTD., Suzhou (CN); OPPLE LIGHTING CO., LTD., Shanghai (CN)

( * ) Notice: Subject to any disclaimer, the term of this patent is extended or adjusted under 35 U.S.C. 154(b) by 0 days.

(21) Appl. No.: 17/836,971

(22) Filed: Jun. 9, 2022

(65) Prior Publication Data

US 2022/0299198 A1 Sep. 22, 2022

Related U.S. Application Data

(63) Continuation of application No. PCT/CN2020/135295, filed on Dec. 10, 2020.

(30) Foreign Application Priority Data

Dec. 12, 2019 (CN) ..... 201922228836.8

(51) Int. Cl.

| | |
|---|---|
| ***F21V 23/04*** | (2006.01) |
| ***F21V 21/22*** | (2006.01) |
| ***F21V 21/30*** | (2006.01) |

(52) U.S. Cl.

CPC ..... *F21V 23/0485* (2013.01); *F21V 21/22* (2013.01); *F21V 21/30* (2013.01)

(58) Field of Classification Search

CPC ..... F21V 21/22; F21V 21/30; F21V 21/12; F21V 21/34; F21V 23/0492; F21V 23/0485; F21S 8/028; F21S 6/003; F21S 6/006; F21S 6/00

See application file for complete search history.

(56) References Cited

U.S. PATENT DOCUMENTS

| | | | | |
|---|---|---|---|---|
| 9,675,507 | B1 * | 6/2017 | Wilson-Hunter | G09F 17/00 |
| 2004/0114373 | A1 * | 6/2004 | Lin | F21S 6/003 362/186 |
| 2009/0091940 | A1 * | 4/2009 | Probasco | F21S 8/028 362/372 |

(Continued)

FOREIGN PATENT DOCUMENTS

CN 108361576 A * 8/2018

*Primary Examiner* — Jong-Suk (James) Lee
*Assistant Examiner* — Glenn Zimmerman
(74) *Attorney, Agent, or Firm* — Arch & Lake LLP

(57) ABSTRACT

The present disclosure provides a lamp. The lamp includes a lamp holder including a first shell and a light source module, where the first shell includes a first inner chamber and a through hole which is in communication with the first inner chamber, and the light source module is movably disposed in the first inner chamber, and at least part of the light source module extends out of the first inner chamber or retracts into the first chamber through the through hole. The lamp further includes a support column and a lamp base, where the first shell is supported on the lamp base through the support column.

12 Claims, 8 Drawing Sheets

(56) References Cited

U.S. PATENT DOCUMENTS

| | | | | |
|---|---|---|---|---|
| 2011/0182063 | A1* | 7/2011 | Hsieh | F21V 21/30 362/220 |
| 2012/0314418 | A1* | 12/2012 | Byrne | F21V 21/22 362/419 |
| 2020/0355359 | A1* | 11/2020 | Pan | F21S 6/00 |
| 2022/0120393 | A1* | 4/2022 | Shao | F21V 21/28 |

* cited by examiner

LAMP

CROSS-REFERENCE TO RELATED APPLICATION

This application is filed based upon and claims priority to PCT International Application No. PCT/CN2020/135295, filed on Dec. 10, 2020, which claims the priority to Chinese Patent Application No. 201922228836.8 filed on Dec. 12, 2019, the entire content of which is incorporated herein by reference for all purposes.

TECHNICAL FIELD

The present disclosure relates to the technical field of lighting equipment, in particular to a lamp.

BACKGROUND

A lamp as a kind of lighting equipment, has been widely used in people's daily life and work, and with the continuous improvement of the quality of life, people have higher requirements on the structure, performance, appearance of lamps, which brings a huge challenge to the design of lamps.

The lamp usually includes a lamp holder, a lamp base and a support column. The lamp holder and the lamp base are connected by the support column, and the lamp holder is hinged with the support column, so that the lamp holder may rotate relative to a bracket, thereby enabling the adjustment of the lamp holder.

However, during the use of the above-mentioned lamps, a height of the lamp and a lighting orientation of the lamp may merely be adjusted in a limited direction, which may not satisfy a user to use in different scenarios, thereby limiting the use of the lamps, and thus the use efficiency of the lamp is low.

SUMMARY

The present disclosure provides a lamp. According to a first aspect of the present disclosure, a lamp is provided. The lamp includes: a lamp holder including a first shell and a light source module, where the first shell has a first inner chamber and a through hole which is in communication with the first inner chamber, and the light source module is movably disposed in the first inner chamber, and at least part of the light source module extends out of the first inner chamber or retracts into the first chamber through the through hole. The lamp may further include a support column and a lamp base, where the first shell is supported on the lamp base through the support column.

BRIEF DESCRIPTION OF THE DRAWINGS

The drawings described herein are provided to further understand the present disclosure and constitute a part of the present disclosure. The examples of the present disclosure and their descriptions explain the present disclosure, and do not have an improper limitation on the present disclosure. In the drawings.

DETAILED DESCRIPTION

Figure 1:
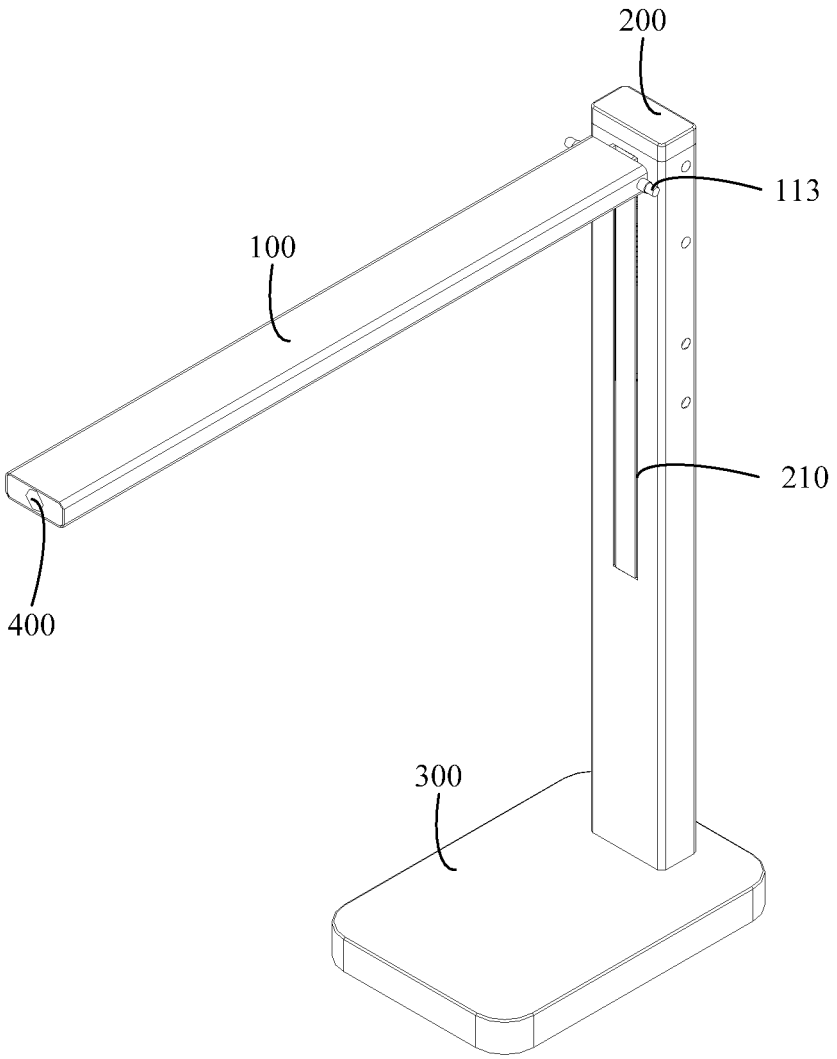
FIG. 1 is a schematic structural diagram of a lamp according to an example of the present disclosure.

In order to make objectives, technical details and advantages of the examples of the present disclosure more clearly, the technical solutions of the examples will be described in a clearly and fully understandable way in connection with the drawings related to the examples of the present disclosure. Apparently, the described examples are just a part but not all of the examples of the present disclosure. Based on the described examples herein, those skilled in the art may obtain other example(s), without any inventive work, which should be within the scope of the present disclosure.

Description of reference numerals used in this disclosure may include:

100—lamp holder, 110—first shell, 111—bracket, 112—shell part, 113—rotation shaft, 120—light source module, 130—second shell, 200—support column, 210—guide hole, 300—lamp base, 400—control switch, 510—slide rail assembly, 511—first slide rail, 512—second slide rail, 520—constant force spring, 530—balance block, 600—first sensor, 710—connection protrusion, 720—anti-rotation protrusion.

The following will describe technical solutions disclosed in various examples of the present disclosure in detail with reference to the accompanying drawings.

Figure 2:
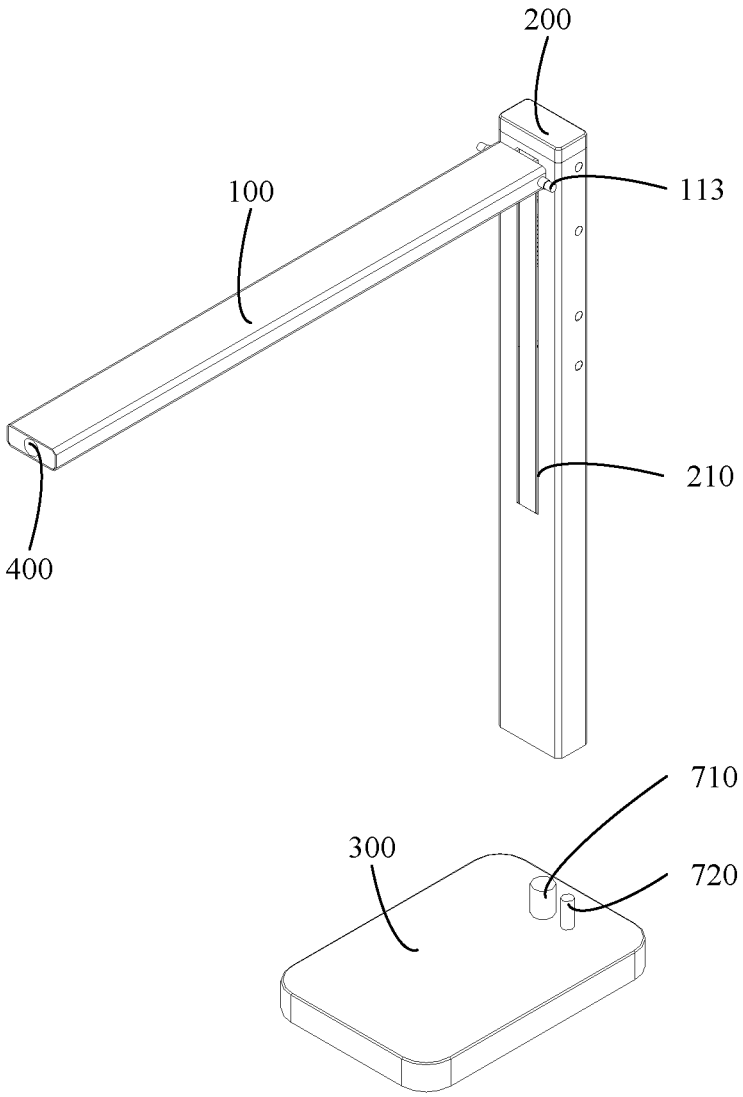
FIG. 2 is a schematic structural diagram of a lamp when a support column separated from a lamp base according to an example of the present disclosure.
Figure 3:
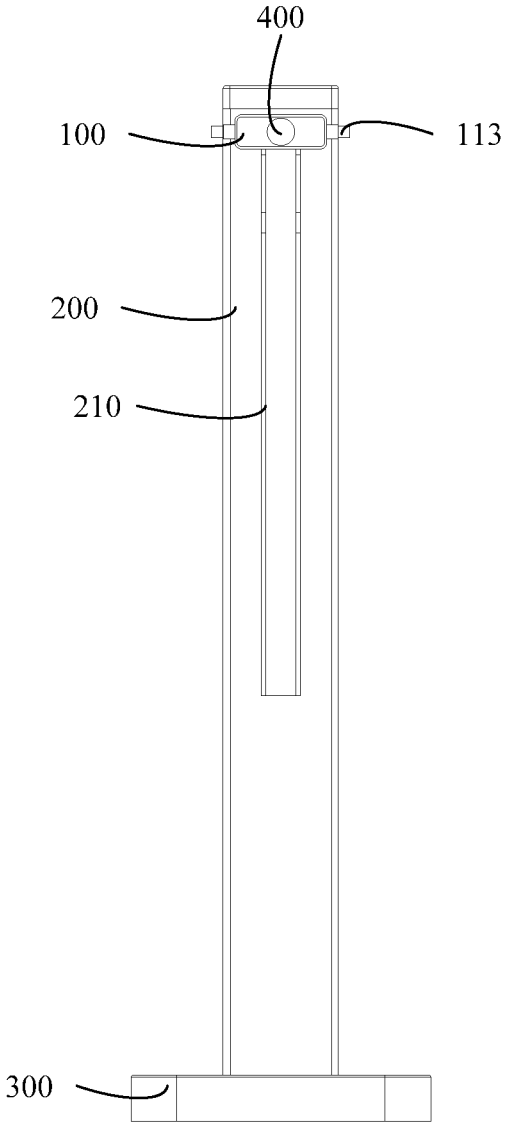
FIG. 3 is a side view of a lamp according to an example of the present disclosure.
Figure 4:
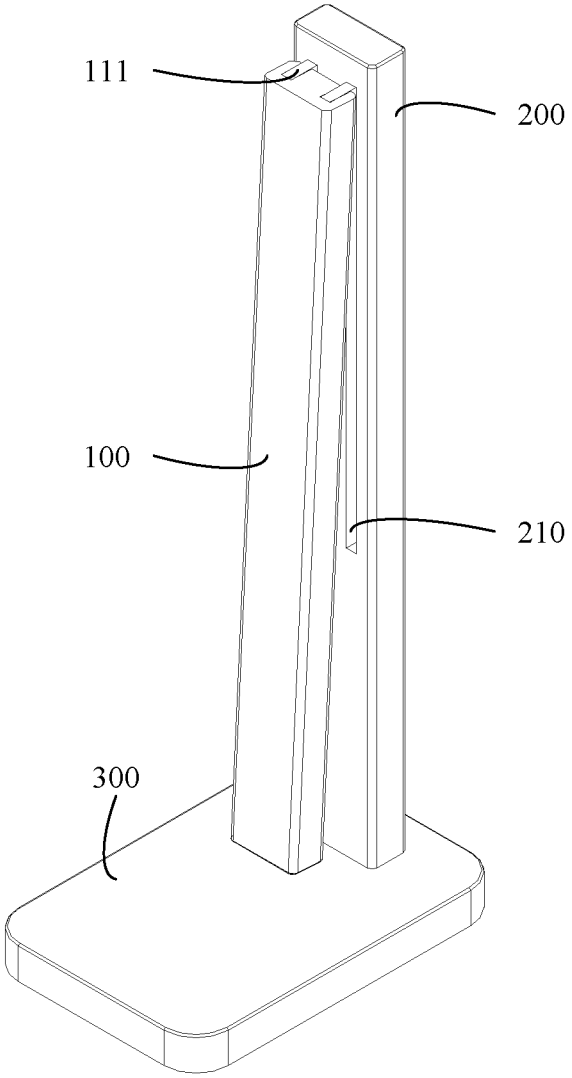
FIG. 4 is a schematic structural diagram of a lamp when folded according to an example of the present disclosure.
Figure 5:
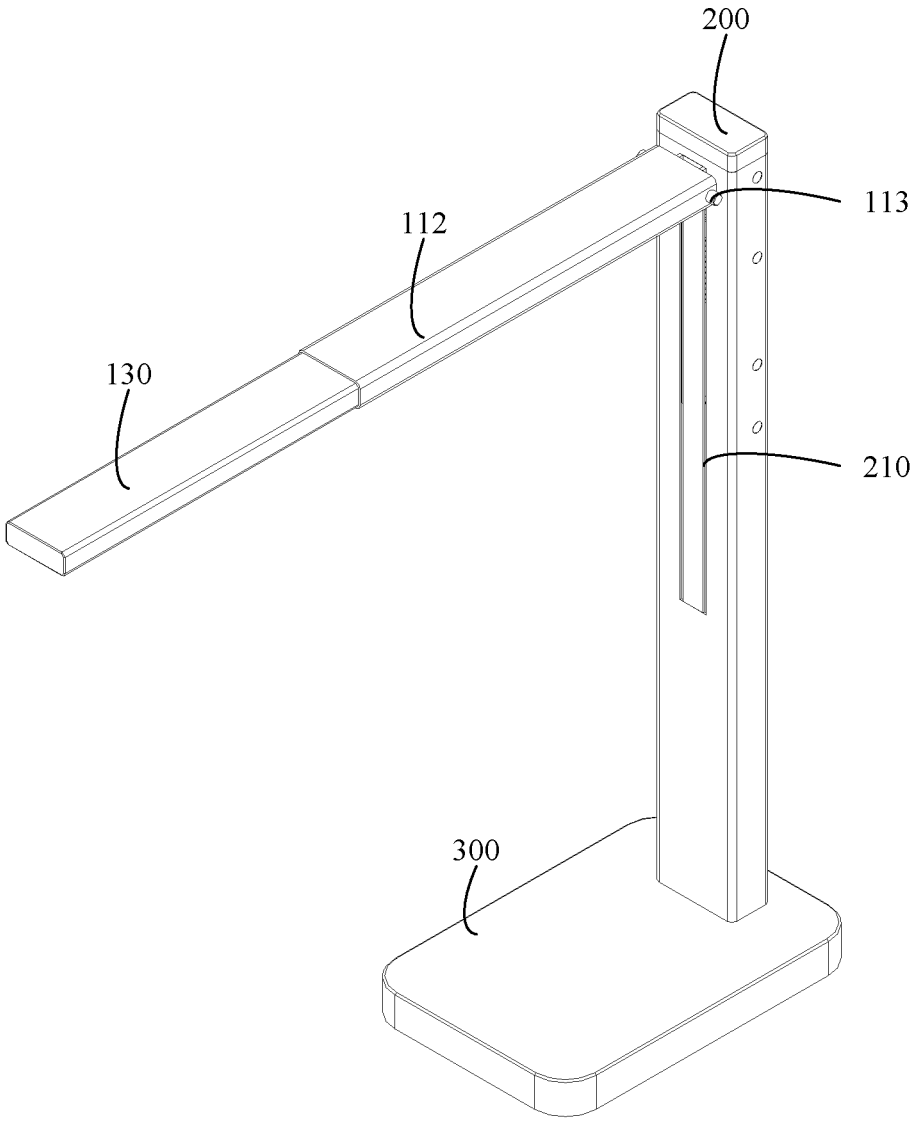
FIG. 5 is a schematic structural diagram of a lamp when a light source module extends according to an example of the present disclosure.
Figure 6:
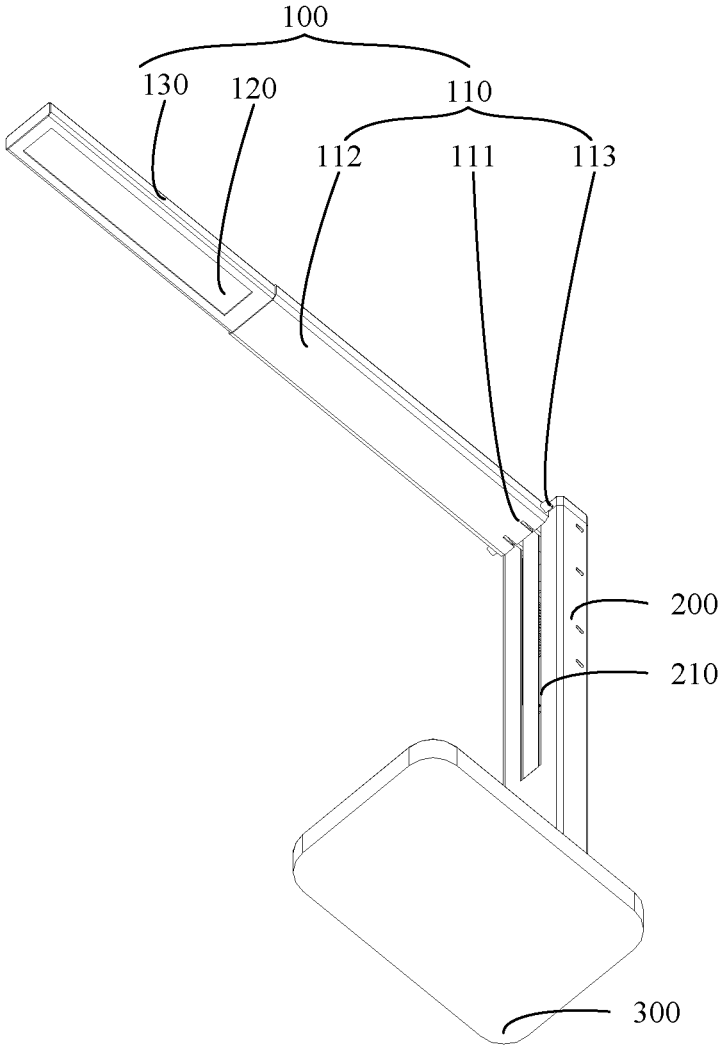
FIG. 6 is a schematic diagram of FIG. 5 from another angle.
Figure 7:
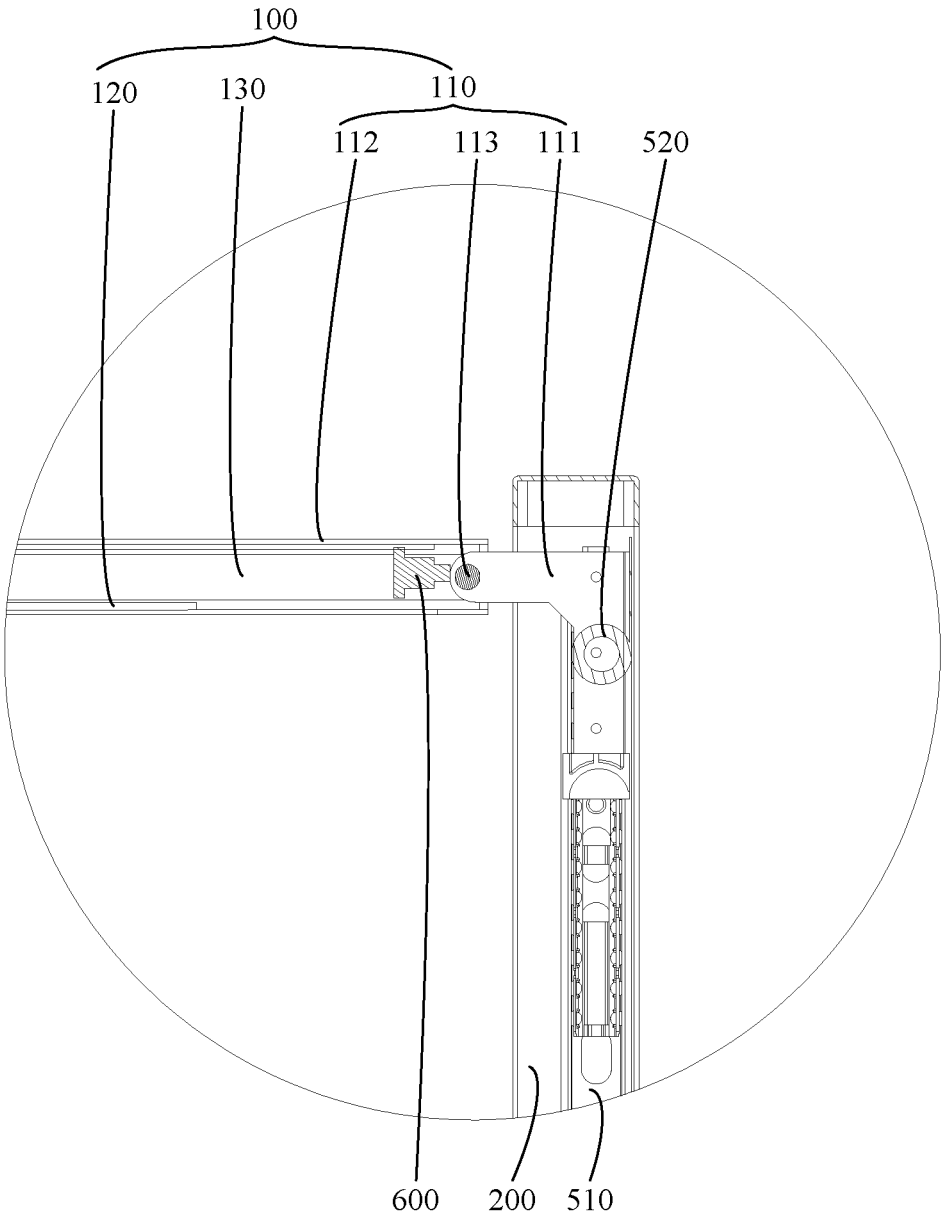
FIG. 7 is a partial section view of a lamp according to an example of the present disclosure.
Figure 8:
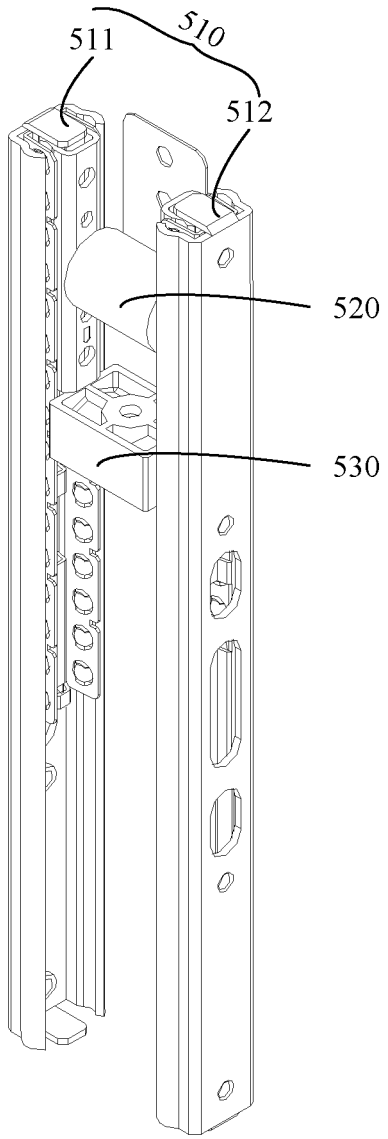
FIG. 8 is a schematic structural diagram of a slide rail assembly of a lamp according to an example of the present disclosure.

As shown in FIG. 1 to FIG. 8, the examples of the present disclosure disclose a lamp, which may include a lamp holder 100, a support column 200 and a lamp base 300.

The lamp holder 100 includes a first shell 100 and a light source module 120, and the first shell 100 has a first inner chamber and a through hole communicating with the first inner chamber, and the light source module 120 is movably disposed in the first inner chamber, and at least part of the light source module 120 may extend out of the first inner chamber or retract into the first inner chamber through the through hole. Alternatively, the user may apply a force to the light source module 120 to drive the light source module 120 to move, or the first inner chamber may also be provided with a driving mechanism, which is connected to the light source module 120 to drive the light source module 120 to move. The driving mechanism may be a linear motor, a cylinder and other driving components.

The first shell 110 is supported by the lamp base 300 through the support column 200, and the lamp base 300 is used for installing the lamp holder 100. Alternatively, a battery or an electrical connection plug may be provided in the lamp for power supply, and the battery or electrical connection plug may be disposed on the lamp holder 100 or the lamp base 300, or even on the support column 200.

In the example of the present disclosure, during the light source module 120 extending out of the first inner chamber through the through hole, the light-emitting area of the light source module 120 increases, thereby increasing the illumination range of the lamp and increasing the brightness of the lamp; during the light source module 120 retracting into the first chamber through the through hole, the light-emitting area of the light source module 120 is reduced, thereby reducing the illumination range and reducing the brightness of the lamp; in this way, by adjusting the position of the light source module 120 in the first chamber, the illumination range and the brightness of the light source module may be adjusted, so that the user's application in different scenarios may be satisfied, thereby improving the use efficiency of the lamp.

In addition, when the lamp is not used, the light source module 120 may all be disposed in the first inner chamber, thereby preventing the light source module 120 from damage.

Alternatively, the first shell 110 may be made of a material with low light transmittance, so that when the light source module 120 is all located in the first inner chamber, the brightness of the lamp is low. In this way, the lamp may be used in modes with lower requirements for lighting conditions (for example, night-light mode), thereby increasing the use of the lamp, to further improve the use efficiency of the lamp.

In an alternative example, the lamp disclosed in the present disclosure may further include a first sensor. The first sensor 600 is provided at one end of the first shell 110 close to the support column 200, and the through hole is provided at the other end of the first shell 110, and the first sensor 600 is configured to detect the position data between itself and the light source module 120. Alternatively, the position data detected by the first sensor 600 may be the distance data between itself and the light source module 120, or the force data between itself and the light source module 120. Therefore, the first sensor 600 may be a distance sensor or a force sensor.

When the first sensor 600 is a distance sensor, during the light source module 120 extending out of the first shell through the through hole, the distance between the light source module 120 and the first sensor 600 gradually increases, and the greater the extension of the light source module 120, the greater the power and the greater the brightness of the light source module 120. During light source module 120 retracting into the first shell through the through hole, the distance between the light source module 120 and the first sensor 600 gradually decreases, and the smaller the extension of the light source module 120, the lower the power, and the smaller the brightness of the light source module 120. At this time, the first sensor 600 transmits the detected distance data to a controller of the lamp, which is electrically connected to the power supply of the lamp, thereby controlling the power supply to adjust the power of the lamp. The distance between the first sensor 600 and the light source module 120 is proportional to the power of the light source module 120.

At this time, during the light module 120 extending or retracting, the power of the light source module 120 also changes accordingly. Therefore, the power of the light source module 120 may be adjusted according to the amount of extension of the light source module 120, so as to make the light energy saving of the lamp is better. Meanwhile, by adjusting the power of the light source module 120, the brightness of the light source module 120 is controlled, so that the brightness of the lamp may not only satisfy the lighting requirements of users, but also reduce the damage to users' eyes.

When the first sensor 600 is a force sensor, there are two conditions of compression and tension for the first sensor 600 and the light source module 120. When the first sensor 600 and the light source module 120 are compressed, during the light source module 120 extending out of the first shell through the through hole, the pressure between the light source module 120 and the first sensor 600 is gradually reduced, and the smaller the pressure between the light source module 120 and the first sensor 600, the greater the power of the light source module 120 and the greater the brightness of the light source module 120; during the light source module 120 retracting into the first shell through the through hole, the pressure between the light source module 120 and the first sensor 600 is gradually increased, and the greater the pressure between the light source module 120 and the first sensor 600, the lower the power of the light source module 120 and the lower the brightness of the light source module 120.

When the first sensor 600 and the light source module 120 are tensioned, during the light source module 120 extending out of the first shell through the through hole, the tension between the light source module 120 and the first sensor 600 is gradually increased. The greater the tension between the light source module 120 and the first sensor 600, the greater the power of the light source module 120 and the greater the brightness of the light source module 120. During the light source module 120 retracting into the first shell through the through hole, the tension between the light source module 120 and the first sensor 600 is gradually reduced. The smaller the tension between the light source module 120 and the first sensor 600, the smaller the power of the light source module 120 and the lower the brightness of the light source module 120.

At this time, the first sensor 600 transmits the detected force data to the controller of the lamp, and the controller is electrically connected to the power supply of the lamp, so as to control the power supply to adjust the power of the lamp.

Alternatively, during increasing or decreasing the distance data or force data between the light source module 120 and the first sensor 600, it may be stepless adjusted, or may be increased or decreased with a small gradient, and the power of the corresponding light source module 120 may be stepless adjusted, or may also be increased or decreased with a small gradient.

In another example, the light source module 120 includes a plurality of light-emitting areas sequentially distributed in its moving direction. The light-emitting area covered by the first shell 110 and the light-emitting area exposed to the first shell 110 are controlled independently. In this case, a third sensor may be provided on the lamp, and the third sensor is configured to detect the area of the light-emitting area covered by the first shell 110 of the light source module 120, or the area of the light-emitting area exposed to the first shell 110, thereby transmitting the detected data to the controller. In this case, the controller may adjust the light source module 120 so that the brightness of the light-emitting area exposed to the first shell 110 is greater than the brightness of the light-emitting area covered by the first shell 110, or turn off the light-emitting area covered by the first shell 110. In this way, the power loss of the light source module 120 is effectively reduced, and the energy-saving performance of the lamp is further improved.

During the light source module 120 extending out of the first inner chamber through the through hole, the area of the light emitting area exposed to the first shell 110 gradually increases, so that the brightness of the light emitting area exposed to the first shell 110 gradually increase.

During the light source module 120 retracting into the first inner chamber through the through hole, the area of the light emitting area exposed to the first shell 110 gradually reduces, so that the brightness of the light emitting area exposed to the first shell 110 gradually reduce.

Alternatively, the first shell 110 and the support column 200 are slidably connected in the extension direction of the support column 200, so as to adjust the height of the lamp holder 100, so that the height of the light source module 120 may be adjusted, which further increases the application scenarios of the lamp.

In an alternative example, the first shell 110 may include a shell part 112 and a bracket 111, and the shell part 112 has a first inner chamber, and the support column 200 is connected to the shell part 112 through the bracket 111, and the bracket 111 is slidably connected with the support column 200 in the extension direction of the support column 200, and the bracket 111 is rotatably connected with the shell part 112. In this way, the shell part 112 may be rotated relative to the support column 200, so that the shell part 112 may be folded, thereby making the volume of the lamp smaller and convenient for storage. Meanwhile, the shell part 112 may rotate relative to the support column 200, thereby driving the light source module 120 to rotate, so as to adjust the irradiation direction of the light source module 120, which further satisfies the user's application in different scenarios, thus further improving the use efficiency of the lamps.

Specifically, the first shell 110 also includes a rotation shaft 113, and the bracket 111 is pivotally connected with the shell part 112 through the rotation shaft 113, and the rotation direction of the shell part 112 is a direction approaching or away from the support column 200. In this way, the bracket 111 and the shell part 112 are merely pivotally connected by the rotation shaft 113, which make the structure of the lamp simple and the manufacturing cost low. Alternatively, the rotation shaft 113 is tightly matched with the bracket 111 and the shell part 112, and thus when the shell part 112 is rotated to a position, it may be fixed relative to the bracket 111, without an additional positioning mechanism.

Alternatively, the rotation angle between the shell part 112 and the support column 200 may be between 0° and 90°. If the rotation angle between the shell part 112 and the support column 200 is 0°, the shell part 112 is parallel to the support column 200, so that the lamp holder 100 is in a fully collapsed state; if the rotation angle of the shell part 112 and the support column 200 is 90°, the shell part 112 is perpendicular to the support column 200, so that the lamp holder 100 is in a fully extended state. The shell part 112 and the support column 200 are provided with a limiting mechanism to limit the rotation angle of the shell part 112 and the support column 200, thereby preventing the shell part 112 from rotating too large and causing damage to the shell part 112. Of course, the rotation angle of the shell part 112 and the support column 200 may also be set to other ranges, which is not limited herein.

In an alternative example, the lamp disclosed in the present disclosure may further include a second sensor. The second sensor is disposed at an end of the shell part 112 close to the bracket 111 and the through hole is disposed at the other end of the shell part 112. The second sensor is configured to detect the angle between the shell part 112 and the support column 200. In this way, the closer the shell part 112 to the support column 200 during the rotation, the lower the power of the light source module 120; the farther away the shell part 112 from the support column 200 during the rotation, the greater the power of the light source module 120. The angle between the shell part 112 and the support column 200 is proportional to the power of the light source module 120. Therefore, the power of the light source module 120 may be adjusted according to the angle between the shell part 112 and the support column 200, so that the lamp has better energy-saving performance. Alternatively, the second sensor may be an angle sensor, and the second sensor is electrically connected to the controller of the lamp, and the second sensor transmits the detected angle data to the controller, so that the controller may adjust the power of the light source module 120.

In another example, the second sensor may be a pressure sensor. The second sensor is provided in the shell part 112 and is in contact with the bracket 111, and the second sensor is configured to detect the pressure between the second sensor and the bracket 111. During the rotation of the shell part 112, the second sensor rotates with the shell part 112. The closer the shell part 112 to the support column 200, the greater the pressure between the second sensor and the bracket 111, so that the power of the light source module 120 is reduced. During the rotation of the shell part 112, the further away the shell part 112 from the support column 200, the smaller the pressure between the second sensor and the bracket 111, so that the power of the light source module 120 is greater. The pressure between the second sensor and the bracket 111 is inversely proportional to the power of the light source module 120.

Alternatively, the second sensor is electrically connected to the controller of the lamp, and the second sensor transmits the detected pressure data to the controller, so that the controller may adjust the power of the light source module.

Alternatively, during increasing or decreasing the angle between the shell part 112 and the support column 200 or the pressure between the second sensor and the bracket 111, it may be stepless adjusted, or it may be increased or decreased with a small gradient, and the power of the corresponding light source module 120 may be stepless adjusted, or may be increased or decreased with a small gradient.

In the above example, the support column 200 may be provided with a first magnetic part, and the bracket 111 may be provided with a second magnetic part. The first magnetic part is magnetically connected to the second magnetic part, and the second magnetic part may be moved relative to the first magnetic part, so that the bracket 111 is moved relative to the support column 200. However, when the magnetic attraction force of the first magnetic part and the second magnetic part is large, the bracket 111 needs to be applied with a large force to drive the bracket 111 to move. When the magnetic attraction of the first magnetic part and the second magnetic part is small, the second magnetic part is easy to fall off from the first magnetic part, thus reducing the safety of the lamp. Therefore, the machining accuracy of the first magnetic part and the second magnetic part is high, resulting in high manufacturing cost of the lamp.

In another example, the support column 200 may have a second inner chamber, the support column 200 may be provided with a guide hole 210 which communicates with the second inner chamber, and the second inner chamber is provided with a slide rail assembly 510, and a bracket 111 passes through the guide hole 210 to be slidably connected to the slide rail assembly 510. In this solution, the bracket 111 is slidably connected to the slide rail assembly 510, and the bracket 111 may move along the extension direction of the slide rail assembly 510, and thus the machining accuracy requirements for the slide rail assembly 510 and the bracket 111 are low, thereby reducing the manufacturing cost of the lamp. The support column 200 may be provided with fastening screws, and when the bracket 111 needs to be moved, the fastening screws need to be screwed first so that the bracket 111 may move along the slide rail assembly 510, and after the bracket 111 moves to the specified position, the fastening screws need to be screwed again to make the fastening screws against the support 111, so as to fix the support 111 in the specified position.

In the above example, the fastening screws may be disposed on the support column 200, and the fastening screws may be screwed so that the fastening screws are against the bracket 111 to position the bracket 111. However, in this way, when the height of the first shell 110 of the lamp is adjusted, the fastening screws need to be screwed first, and the bracket 111 is separated from the fastening screws, and when the first shell 110 is moved to the specified height, the fastening screws need to be screwed again to against the bracket 111, so as to fix the first shell 110. This method is complicated to operate and makes the operation of the lamp cumbersome. Meanwhile, when the fastening screws are disposed on the support column 200, it is necessary to avoid the circuit structure within the support column 200, and thus it is difficult to arrange the circuit structure within the support column 200.

In an alternative example, the lamp disclosed may also include a constant force spring 520, which has a moving end connected to a bracket 111. The moving end is extended or retracted in the extension direction of the slide rail assembly 510. Since the moving end may keep its position unchanged in the case of that it is extended, the first shell 110 may be fixed at a designated position, thus making the operation of the lamp simple. Meanwhile, the circuit structure in the support column 200 may be arranged under the constant force spring 520. In this way, the movement of the bracket 111 will not be affected, and it is not difficult to dispose the circuit structure within the support column 200. Alternatively, the constant force spring 520 may be installed on the slide rail assembly 510, or the constant force spring 520 may be installed on the side wall of the second inner chamber.

Due to a small thickness of the constant force spring 520, the balance between the moving end and the bracket 111 is poor, which easily causes the bracket 111 to shake on the slide rail assembly 510. For this reason, the lamp disclosed in the present disclosure may further include a balance block 530, and the bracket 111 is connected to the moving end through a balance block 530. This solution may improve the balance between the moving end and the bracket 111, so that the bracket 111 is not prone to shake when it slides, so that the bracket 111 slides more smoothly.

In order to prevent the bracket 111 from being skewed in sliding, which causes the bracket 111 to jam, in an alternative example, the slide rail assembly 510 may include a first slide rail 511 and a second slide rail 512. The first slide rail 511 and the second slide rails 512 are arranged oppositely, and the first slide rails 511 and the second slide rails 512 are respectively slidably connected with the bracket 111. Since both sides of the bracket 111 are arranged with sliding rails for guiding, it is possible to prevent the bracket 111 from being skewed in sliding, thereby making the bracket 111 more stable in sliding.

In the above example, the light source module 120 is provided with the circuit structure and the electronic component. When the light source module 120 is directly provided in the first shell 110, during the movement of the light source module 120, the circuit structure and electronic components are likely to collide with the inner wall of the first shell 110, resulting in damage of the circuit structure and electronic components. To this end, in an alternative example, the above-mentioned lamp holder 100 may further include a second shell 130. At least a part of the second shell 130 may extend out of the first chamber or retract into the first chamber through the through hole, and the light source module 120 is disposed on the second shell 130. In this way, only the light-emitting surface of the light source module 120 is exposed, and both the circuit structure and electronic components of the light source module 120 are hidden in the second shell 130, so that when the light source module 120 moves, the circuit structure and electronic components will not collide with the inner wall of the first shell 110, so as not to damage the circuit structure and electronic components, thus improving the safety and reliability of the lamp.

In an alternative example, the lamp base 300 is detachably connected to the support column 200. In this way, the support column 200 may be detached from the lamp base 300, so that the lamp may be easily stored. Alternatively, the lamp base 300 and the support column 200 may be connected by a magnetic attraction, a snap connection or a threaded connection.

When the lamp base 300 and the support column 200 are connected by magnetic attraction, in the case of the magnetic attraction between the lamp base 300 and the support column 200 being small, the support column 200 is easy to fall off from the lamp base 300, and in the case of the magnetic attraction force between the lamp base 300 and the support column 200 being large, the support column 200 and the lamp base 300 are inconvenient to disassemble. Therefore, the machining accuracy of the magnetic parts for the magnetic attraction in the lamp base 300 and the support column 200 is high, which makes the manufacturing cost of the lamp high. The lamp base 300 and the support column 200 may also be connected by a snap connection. However, a multiple disassembly of the lamp base 300 and the support column 200 may easily cause a snap hook to break, which makes the reliability of the lamp low. The lamp base 300 and the lamp may also be connected by threads, and this method requires threaded holes to be provided on the support column 200 or the lamp base 300. The threaded holes are provided on the appearance surface of the lamp, resulting in poor appearance texture of the lamp, thereby making the user experience poor.

To this end, in another example, one of the lamp base 300 and the support column 200 is provided with a connection protrusion 710, and the other is provided with a connection groove. The connection protrusion 710 is matched with the connection groove in a plug-in manner. In this way, the connection protrusion 710 is inserted into the connection groove, and the machining accuracy of the connection protrusion 710 and the connection groove is low, thereby reducing the manufacturing cost of the lamp. Meanwhile, the connection protrusion 710 and the connection groove have no force effect in the insertion and removal process. Thus, the connection protrusion 710 or the connection groove will not be damaged. Therefore, the reliability of the lamp is high. In addition, the connection protrusion 710 is located in the connection groove, and the connection protrusion 710 and the connection groove will not be exposed. Thus, the appearance texture of the lamp is good and the user experience is improved.

In the above example, in order to enable the connection protrusion 710 to be smoothly inserted into the connection groove, a size of the connection protrusion 710 is smaller than a size of the connection groove, but this causes a gap between the connection protrusion 710 and the connection groove, so that the support column 200 may rotate relative to the lamp base 300. To this end, in an alternative example, the lamp base 300 or the support column 200 may also be provided with an anti-rotation protrusion 720. The anti-rotation protrusion 720 and the connection protrusion 710 are spaced apart. The anti-rotation protrusion 720 is inserted and matched with the connection groove in a plug-in manner. In this way, the anti-rotation protrusion 720 may prevent the connection protrusion 710 from rotating in the connection groove, thereby preventing the support column 200 from rotating relative to the lamp base 300.

In the above example, the lamp disclosed in the present disclosure may further include a control switch 400 for controlling the light source module 120 to be turned on or off. The control switch 400 may be disposed on a side wall of the first shell 110. However, when the user adjusts the height of the first shell 110, the side wall of the first shell 110 needs to be held by hand, which is easy for the user to touch the control switch 400, resulting in user's misoperation. In an alternative example, the control switch 400 may be disposed at an end of the first shell 110 away from the support column 200. In this way, it is not easy for the user to touch the control switch 400 when holding the first shell 110, so that it is not easy to cause the user's misoperation. Alternatively, the control switch 400 may be a press switch or a touch switch, and the control switch 400 may also be provided with a plurality of control gears, so that the brightness of the light source module 120 may be adjusted.

The lamps disclosed in the examples of the present disclosure may be desk lamps or floor lamps. Of course, the lamp may also be other lighting equipment, which is not limited in the example of the present disclosure.

The present disclosure provides a lamp. The lamp may include a lamp holder including a first shell and a light source module, where the first shell may include a first inner chamber and a through hole which is in communication with the first inner chamber, and the light source module is movably disposed in the first inner chamber, and at least part of the light source module is capable of extending out of the first inner chamber or retracting into the first chamber through the through hole.

Further, the lamp may include a support column and a lamp base, where the first shell is supported on the lamp base through the support column.

In some examples, the lamp may further include a first sensor, and the first sensor is disposed at one end of the first shell close to the support column, and the through hole is disposed at the other end of the first shell, and the first sensor is configured to detect position data between the first sensor and the light source module.

In some examples, the light source module may include a plurality of light emitting areas sequentially distributed in a moving direction of the light source module, where a light-emitting area covered by the first shell and a light-emitting area exposed to the first shell are independently controlled.

In some examples, the first shell may include a shell part and a bracket, and the shell part may include the first inner chamber, and the support column is connected to the shell part through the bracket, and the bracket and the support column are slidably connected in an extension direction of the support column, and the bracket is rotatably connected with the shell part.

In some examples, the first shell may further include a rotation shaft, and the bracket is pivotally connected with the shell part through the rotation shaft, and a rotation direction of the shell part is a direction approaching or away from the support column.

In some examples, the lamp may further include a second sensor, and the second sensor is disposed at an end of the shell part close to the bracket, and the through hole is disposed at the other end of the shell part, and the second sensor is configured to detect an angle between the shell part and the support column.

In some examples, the support column may have a second inner chamber, the support column may include a guide hole, and the guide hole communicates with the second inner chamber, the second inner chamber may include a slide rail assembly, and the bracket passes through the guide hole and is slidably connected to the slide rail assembly.

In some examples, the lamp may further include a constant force spring, and the constant force spring may include a moving end, and the moving end is connected to the bracket, and the moving end extends or retracts in an extension direction of the slide rail assembly.

In some examples, the lamp may further include a balance weight, and the bracket is connected to the moving end through the balance weight.

In some examples, the slide rail assembly may include a first slide rail and a second slide rail, and the first slide rail and the second slide rails are oppositely arranged, and the first slide rail and the second sliding rail are respectively slidably connected with the bracket.

In some examples, the lamp holder may further include a second shell, and at least part of the second shell is capable of extending out of the first inner chamber or retracting into the first inner chamber through the through hole, and the light source module is disposed on the second shell.

In some examples, the lamp base and the support column are detachably connected, and one of the lamp base and the support column comprises a connection protrusion, and the other comprises a connection groove, and the connection protrusion is matched with the connection groove in a plug-in manner.

In some examples, the lamp may be a desk lamp or a floor lamp.

The technical solutions adopted by the present disclosure may achieve following beneficial effects:

In the lamp disclosed in the present disclosure, during the light source module extending out of the first inner chamber through the through hole, the light-emitting area of the light source module increases, thereby increasing the illumination range of the lamp and increasing the brightness of the lamp; during the light source module retracting into the first chamber through the through hole, the light-emitting area of the light source module is reduced, thereby reducing the illumination range and reducing the brightness of the lamp. In this way, by adjusting the position of the light source module in the first chamber, the illumination range and the brightness of the light source module may be adjusted, so that the user's application in different scenarios may be satisfied, thereby improving the use efficiency of the lamp. Therefore, the lamp according to the present disclosure solves the problem that the use efficiency of the lamp is low.

In addition, when the lamp is not used, the light source module may all be disposed in the first inner chamber, thereby preventing the light source module from damage.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

What are described above is related to the examples of the present disclosure only and not limitative to the present disclosure. Various modification and change may be made by those skilled in the art. Any modification, equivalent replacement and modification made within the spirit and principle of the present disclosure are regarded as falling within the protection scope of the present disclosure.

The above examples of this disclosure focus on the differences between the various examples. Different optimization features between the various examples may be combined to form a better example, provided that they are not contradictory. Considering the conciseness of the text, they will not be repeated herein.

The above descriptions are merely examples of the present disclosure, and are not used to limit the present disclosure. For those skilled in the art, the present disclosure may have various modifications and changes. Any modification, equivalent replacement, improvement, or others made within the spirit and principle of the present disclosure shall be included in the scope of the claims of the present disclosure.

What is claimed is:

1. A lamp, comprising:

a lamp holder comprising a first shell and a light source module, wherein the first shell has a first inner chamber and a through hole which is in communication with the first inner chamber, and the light source module is movably disposed in the first inner chamber, and at least part of the light source module is capable of extending out of the first inner chamber or retracting into the first chamber through the through hole; and a support column and a lamp base, wherein the first shell is supported on the lamp base through the support column;

wherein the first shell comprises a shell part and a bracket, and the shell part has the first inner chamber, and the support column is connected to the shell part through the bracket, and the bracket and the support column are slidably connected in an extension direction of the support column, and the bracket is rotatably connected with the shell part.

2. The lamp according to claim 1, wherein the lamp further comprises a first sensor, and the first sensor is disposed at one end of the first shell close to the support column, and the through hole is disposed at the other end of the first shell, and the first sensor is configured to detect position data between the first sensor and the light source module.

3. The lamp according to claim 1, wherein the light source module comprises a plurality of light emitting areas sequentially distributed in a moving direction of the light source module, wherein a light-emitting area covered by the first shell and a light-emitting area exposed to the first shell are independently controlled.

4. The lamp according to claim 1, wherein the first shell further comprises a rotation shaft, and the bracket is pivotally connected with the shell part through the rotation shaft, and a rotation direction of the shell part is a direction approaching or away from the support column.

5. The lamp according to claim 1, wherein the lamp further comprises a second sensor, and the second sensor is disposed at an end of the shell part close to the bracket, and the through hole is disposed at the other end of the shell part, and the second sensor is configured to detect an angle between the shell part and the support column.

6. The lamp according to claim 1, wherein the support column has a second inner chamber, the support column comprises a guide hole, and the guide hole communicates with the second inner chamber, the second inner chamber comprises a slide rail assembly, and the bracket passes through the guide hole and is slidably connected to the slide rail assembly.

7. The lamp according to claim 6, wherein the lamp further comprises a constant force spring, and the constant force spring has a moving end, and the moving end is connected to the bracket, and the moving end extends or retracts in an extension direction of the slide rail assembly.

8. The lamp according to claim 7, wherein the lamp further comprises a balance weight, and the bracket is connected to the moving end through the balance weight.

9. The lamp according to claim 6, wherein the slide rail assembly comprises a first slide rail and a second slide rail, and the first slide rail and the second slide rail are oppositely arranged, and the first slide rail and the second slide rail are respectively slidably connected with the bracket.

10. The lamp according to claim 1, wherein the lamp holder further comprises a second shell, and at least part of the second shell is capable of extending out of the first inner chamber or retracting into the first inner chamber through the through hole, and the light source module is disposed on the second shell.

11. The lamp according to claim 1, wherein the lamp base and the support column are detachably connected, and one of the lamp base and the support column comprises a connection protrusion, and the other comprises a connection groove, and the connection protrusion is matched with the connection groove in a plug-in manner.

12. The lamp according to claim 1, wherein the lamp is a desk lamp or a floor lamp.

* * * * *